United States Patent [19]

Corse

[11] 3,987,726

[45] Oct. 26, 1976

[54] OFFSET ROTARY PRESSES

[75] Inventor: Louis Corse, Orleans, France

[73] Assignee: Societe d'Etudes de Machines Speciales, France

[22] Filed: Oct. 23, 1974

[21] Appl. No.: 517,301

[30] Foreign Application Priority Data

Oct. 24, 1973 France ..... 73.37904

[52] U.S. Cl. ..... 101/218; 101/247

[51] Int. Cl.[2] ..... B41F 13/34

[58] Field of Search ..... 101/154, 217, 218, 142, 101/143, 144, 137, 247

[56] References Cited

UNITED STATES PATENTS

| | | | |
|---|---|---|---|
| 1,231,932 | 7/1917 | Olsen | 101/247 |
| 3,041,967 | 7/1962 | Nystrand | 101/218 X |
| 3,606,835 | 9/1971 | Chambon | 101/218 |

FOREIGN PATENTS OR APPLICATIONS

| | | | |
|---|---|---|---|
| 936,437 | 9/1963 | United Kingdom | 101/217 |

*Primary Examiner*—Anton O. Oechsle
*Attorney, Agent, or Firm*—Robert E. Burns; Emmanuel J. Lobato; Bruce L. Adams

[57] ABSTRACT

An offset rotary press comprises one single control device for changing the size on the one hand and for fixing and detaching the cylinders on the other. The press comprises, on each side of the frame, a longitudinal and a horizontal threaded bar screwed by its end into one of the movable side plates, a worm wheel for simultaneously rotating the two threaded bars and causing the two side plates to slide, and compression springs compressed between devices integral with the external ends of the respective horizontal bars and with supporting points affixed to the frame, in such a way as to exert, in the outward direction, a tractive force on each threaded bar and the corresponding side plate and to create the pressure between the blanket cylinder and the engraved cylinder.

2 Claims, 3 Drawing Figures

OFFSET ROTARY PRESSES

BACKGROUND OF THE INVENTION

The present invention relates to an offset printing press.

Presses of this kind are already known which essentially consist of an engraved cylinder tangential to a blanket cylinder or transfer cylinder of flexible material and a cylinder known as the counterpart, in contact with the blanket cylinder, the sheet of paper to be printed moving past between the blanket cylinder and the counterpart cylinder.

In a known machine of this type the blanket cylinder and the counterpart cylinder are supported by two vertical side plates mounted on the frame of the machine in such a way that they can slide longitudinally and horizontally, so as to place the blanket cylinder in contact with the engraved cylinder, causing the two side plates to slide horizontally, a device being provided for converting the horizontal sliding movement of the two side plates into a vertical movement of the counterpart cylinder positioned underneath the blanket cylinder, in such a manner that the counterpart cylinder is always placed in contact with the lower part of the blanket cylinder when this latter itself has been placed in contact with the engraved cylinder. The operation of changing the size can thus be carried out very rapidly, as the operation of placing the blanket cylinder in contact with the engraved cylinder, borne by the frame, automatically fixes the counterpart cylinder in position against the blanket cylinder, whatever the size concerned. A machine of this known kind, however, suffers from the drawback of comprising two distinct mechanisms, one for the change of size and one for the operation of fixing the cylinders against and detaching them from each other.

SUMMARY OF THE INVENTION

The purpose of the present invention is to remedy this drawback by providing a machine with one single control device for these two operations.

For the said purpose, this offset printing press, comprising an engraved cylinder rotatably mounted in bearings permanently affixed to the frame of the machine, a blanket cylinder tangential to the engraved cylinder, a counterpart cylinder tangential to the blanket cylinder and situated below this latter, two vertical side plates bearing the blanket cylinder and the counterpart cylinder and mounted on the frame of the machine in such a way as to slide longitudinally and horizontally, and a longitudinal and a horizontal threaded bar of which the ends are screwed into the respective movable side plates, as well as means for simultaneously rotating the two threaded bars and causing the two movable side plates to slide, is characterized by the fact that compression springs are compressed between devices integral with the external extremities of the respective threaded bars and with supporting points affixed to the frame, in such a way as to exert, in an outward direction, a tractive stress on each threaded bar and the side plate associated therewith and to create the required pressure between the blanket cylinder and the engraved cylinder.

The press according to the invention offers the advantage that with one and the same operating device the compressed blanket cylinder can be simply released, at the beginning of its rotation, after which, as the rotation continues, the two movable sideplates can be moved and the blanket cylinder also displaced in order to enable the latter to be changed. In the opposite direction, the operating device first of all causes the blanket cylinder to move in the direction of the engraved cylinder, until it is in contact therewith, after which the continued rotation of the operating device causes the two cylinders to be pressed against each other, by the compression of the springs.

The press to which the invention relates also includes means by which the pressure exerted by the counterpart cylinder on the blanket cylinder can be adjusted as desired.

BRIEF DESCRIPTION OF THE DRAWING

One version of the present invention will be described hereinafter, by way of an example without any limitative effect, and by reference to the accompanying drawing, in which.

DESCRIPTION OF THE PREFERRED EMBODIMENT

Figure 1:
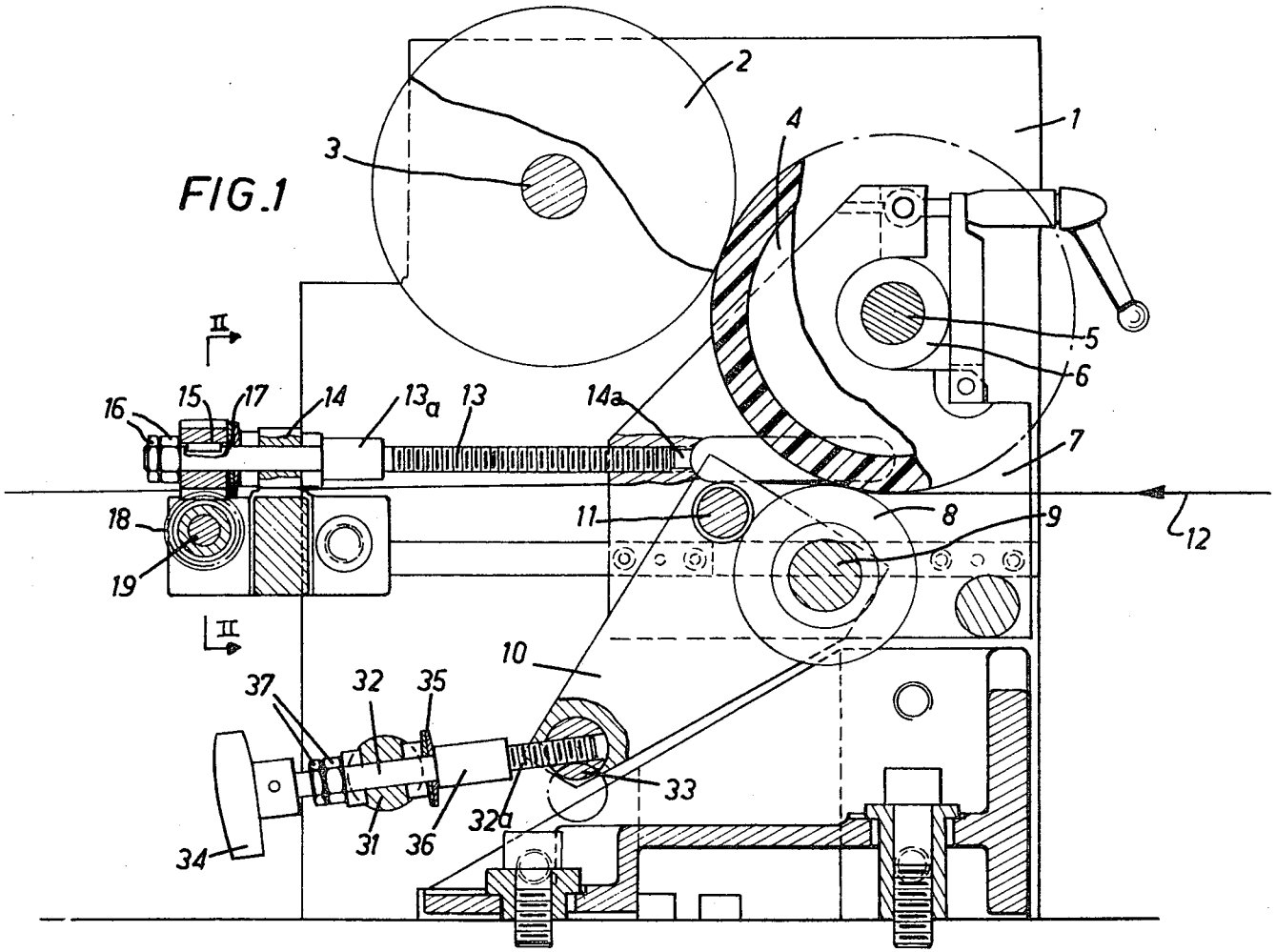
FIG. 1 is a vertical and longitudinal sectional view of an offset rotary press according to the invention.

The offset press according to the invention comprises a fixed frame 1 on the upper part of which is mounted a conventional inking and moistening device not shown in the drawing. This frame 1 bears an engraved cylinder integral with a transversal shaft 3 rotatably mounted in bearings supported by the uprights forming the frame 1 and enabling the engraved cylinder to be rapidly installed and removed.

By the side of the engraved cylinder 2, and tangential thereto, is a blanket cylinder 4, also termed the transfer cylinder. The diameter of the blanket cylinder 4 is the same as that of the engraved cylinder 2 and thus has to be modified when the size is being changed. The blanket cylinder 4 is integral with a transversal and horizontal shaft 5 rotatably mounted in bearings 6 locked in position in recesses provided in two lateral and vertical plates 7 adjacent to the two uprights of the frame 1.

Underneath the blanket cylinder 4, and in contact therewith, is a counterpart cylinder 8 extending in the horizontal and transversal directions. The shaft 9 of this counterpart cylinder is rotatably mounted on the first arms of two levers of the shape of a triangle 10, which are hinged to the respective two side plates 7, about a transversal shaft 11. The sheet of paper 12 to be printed passes from right to left between the blanket cylinder 4, situated above, and the counterpart cylinder 8, situated below.

A description will now be given of a single mechanism by which the movable vertical side plates 7 can be caused to perform a sliding movement in order to change the size and by which the engraved cylinder 2 and the blanket cylinder 4 can also be pressed against each other. This mechanism comprises, on each side of the frame, a screw-threaded bar 13 which extends in the horizontal and longitudinal directions in the proximity of an upright of the frame 1 and of which the end is screwed into an internally threaded hole **14*a* provided in the corresponding movable side plate 7. This bar 13 is rotatably mounted in a bearing 14 supported by the frame 1 and is integral at its external end with a worm wheel 15 locked in position by means of nuts 16. Belleville washers 17 are interposed between the toothed wheel 15 and the bearing 14 and thrust the bar 13 outwards, the latter being locked in position by a collar 13***a*.

Figure 2:
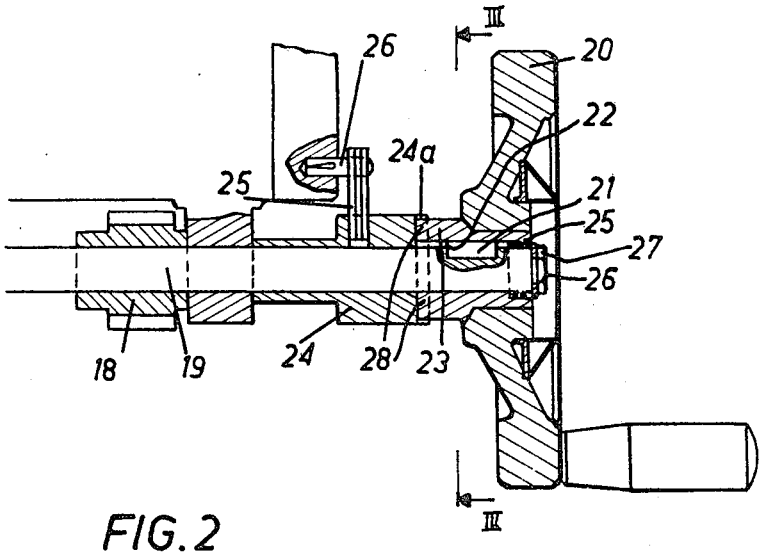
FIG. 2 is a partial vertical and cross section along the line II—II of FIG. 1.

The toothed wheel 15 engages a worm 18, the two worms 18 being themselves borne by one and the same transversal shaft 19, integral at its external end with an operating flywheel 20 (FIG. 2). This flywheel 20 is rendered rotationally integral with the transversal shaft 19 by a key 21 accommodated in a groove 22 of its hub 23. The flywheel is thus capable of sliding in an axial direction on the shaft 19. The said shaft 19 has a sleeve 24 journalled thereon bearing a radial finger 25 capable of making contact with a fixed stop 26 borne by the frame, the said stop consisting, for example, of a cotter pin. The flywheel 20 and the hub 23 are constantly thrust in the direction of the sleeve 24 by a compression spring 25 which bears on the one hand on the hub 23 and on the other hand on a washer 26 locked in position at the end of the shaft 19 by a nut 27 screwed onto this latter. The hub 23 terminates in claws 28 which engage corresponding slots 24*a* provided in the front surface opposite the sleeve 24.

An explanation will now be given of the operation of the single device serving both to change the size and to produce and remove the contact pressure between the cylinders.

Figure 3:
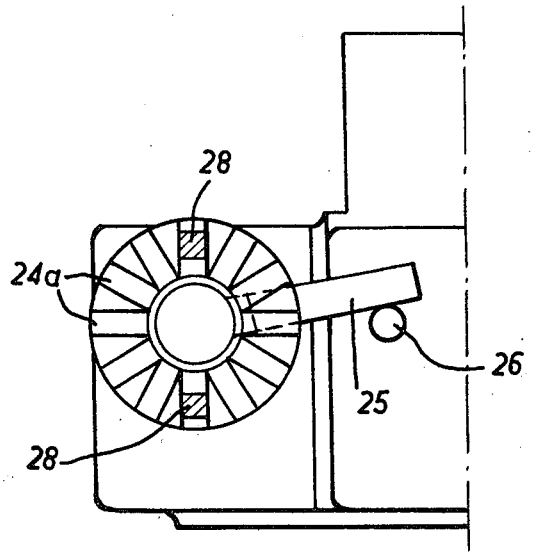
FIG. 3 is a partial cross section along the line III—III of FIG. 2.

Let us suppose that it is desired to change the size while the various elements of the press occupy the position shown on the drawing. The flywheel 20 is then turned by about one revolution in an anticlockwise direction, as shown in FIG. 3, so that the radial finger 25 passes from one side of the stop 26 to the other. This rotation is effected while the flywheel 20 is thrust in the direction of the sleeve 24 and the hub 23 of the said flywheel is coupled to this latter. This rotation of the flywheel 20 of about one revolution is transmitted to the shaft 19 and, via the two pairs of worms 18 and wheels 15, to the two screw-threaded bars 13. The rotation of each bar 13 causes a corresponding movement of the movable side plate 7 in which it is screwed, so that the said side plate tends to slide towards the right, as viewed in FIG. 1, and the blanket cylinder 4 tends to move away from the engraved cylinder 2. The fact is that at the beginning of the rotation of the worm 13 the blanket cylinder 4 remains in contact with the engraved cylinder 2 throughout the period during which the Belleville washers 17 are expanding. The fact is that these latter constantly exert on the bar 13, by resting against the bearing 14 and the toothed wheel 15, a restoring force towards the left, which is transmitted by the side plate 7 to the blanket cylinder 4 and which causes this latter to press against the engraved cylinder 2.

After the shaft 19 has performed one rotation the pressure has been entirely relieved, i.e. the Belleville washers have been expanded. All that is then required, in order to move the blanket cylinder 4 to a sufficient distance from the engraved cylinder and to enable the size to be changed, is to uncouple the flywheel 20 from the sleeve 24, which is still locked in position by the contact of its finger 25 with the stop 26, this operation being performed by pulling the flywheel 20 towards the right, as viewed in FIG. 2. At this moment the claws 28 of the hub 23 disengage themselves from the corresponding notches 24*a* of the hub of the sleeve 24, and the flywheel 20 and the shaft 19 can then be rotated a sufficient number of times to cause the movable side plates 17 and the blanket cylinder 4 to perform the appropriate movement.

Once the change of size has been effected it is sufficient for the flywheel 20, still disconnected from the sleeve 24, to be turned in the opposite direction in order to place the new blanket cylinder 4, which may be either larger or smaller than the preceding one, in contact with the new engraved cylinder 2 of the appropriate new size. As soon as these two cylinders are in contact with each other the flywheel 20 and the sleeve 24 are re-connected, releasing the said flywheel, so that the latter, under the action of the spring 25, is thrust against the sleeve 24 and the claws 28 of its hub 23 engage the notches 24*a* of the sleeve. From this moment onwards, by continuing to turn the flywheel 20 in the same direction, and owing to the fact that the two cylinders 2 and 4 are in contact and that the side plates 7 are immobilized in their movement, the Belleville washers 17 are progressively compressed between the toothed wheel 15 and the bearing 14, this being the case until the completion of the additional revolution, i.e. until the finger 25 once again comes in contact with the stop 26. The Belleville washers 17, thus compressed, exert on each bar 13 a traction towards the left as viewed in FIG. 1 and thus contribute to the production of the necessary pressure between the cylinders 2 and 4.

A description will now be given of the device controlling the adjustment of the pressure of the counterpart cylinder 8. This device comprises a transversal shaft 31 rotatably mounted in the two uprights of the frame 1. This transversal shaft 31 is traversed, at each of its ends, by a diametral bar 32 of which the screw-threaded end 32*a* is screwed into a diametral hole bored in a transversal strut 33 extending between the lower ends of the second arms of the pivot levers 10. Each bar 32 is integral, at its outer extremity, with a pressure regulating button 34 for the counterpart cylinder 8. Furthermore, Belleville washers 35 are compressed between the transversal shaft 31 and the collar 36 of the bar 32 in such a way as to thrust the bar 32 towards the right, as viewed in FIG. 1, by bearing on the shaft 31. The sliding movement of the bar 32 towards the right is limited by nuts 37 screwed onto the said bar 32 and by bearing on the shaft 31 opposite the Belleville washers 35.

The button 34 enables the compression of the Belleville washers 35 to be adjusted upwards or downwards, consequently enabling the pressure exerted by the counterpart cylinder 8 on the blanket cylinder 4 to be likewise adjusted.

When the movable side plates 7 are sliding towards the right, during a change of size, each lever 10 pivots about the shaft 11 in a clockwise direction, so that the counterpart cylinder 8 is lowered. The said counterpart cylinder 8 once again comes in contact with the blanket cylinder 4 when this latter itself is touching the engraved cylinder 2, during a sliding movement of the movable side plates 4 towards the left, after the change of size. This size changing operation is thus effected without any need to modify the setting of the pressure of the counterpart cylinder.

I claim:

1. In an offset rotary press, a frame, bearings permanently mounted on the frame, an engraved cylinder rotatably mounted in the said bearings, a blanket cylinder rotatably mounted tangential to the engraved cylinder, a counterpart cylinder tangential to the blanket cylinder and situated below the blanket cylinder, two movable vertical and longitudinal side plates bearing the blanket cylinder and the counterpart cylinder and mounted slidably in a longitudinal and in a horizontal direction on said frame, two longitudinal and horizontal screw-threaded bars screwed at their inner ends into respective movable side plates, reversible means for simultaneously rotating the two threaded bars and setting up a simultaneous sliding movement in the two movable side plates, first devices and second devices integral respectively with the outer ends of the threaded bars and with supporting points affixed to the frame, compression springs compressed between said first and second devices and the respective supporting points to exert a tractive axial force in an outward direction on each threaded bar and on the side plate associated therewith to produce the required contact pressure between the blanket cylinder and engraved cylinder, said supporting points comprising on each side of the frame, and for each screw-threaded bar, a longitudinal bearing supported by the frame in which a corresponding threaded bar is rotatably mounted, said first and second devices comprising a toothed wheel on each threaded bar secured on an outer end of the corresponding threaded bar, a collar on each threaded bar positioned on the other side of the longitudinal bearing, in relation to the worm wheel to block outward axial movement of the corresponding threaded bar on the corresponding longitudinal bearing, the reversible means for simultaneously rotating the two screw-threaded bars comprising a transverse shaft rotatably mounted in the frame, two transverse worms integral with the transverse shaft axially spaced thereon respectively engaging the toothed wheels integral with the threaded bars, a sleeve rotatably journaled on the transverse shaft, a radial finger affixed to said sleeve, a fixed stop mounted on the frame and with which the radial finger can come in contact on each side of the stop, an operating flywheel mounted to slide axially on the transverse shaft, a key rendering the operating flywheel rotationally integral with the shaft, a spring which constantly thrusts the operating flywheel in the direction of the sleeve, the flywheel having integral therewith a hub normally engaging said sleeve and provided with axial projections for engaging notches distributed over the engaged surface of the sleeve.

2. In an offset rotary press according to claim 1, in which said compression springs comprise Belleville washers.

* * * * *